United States Patent [19]

Ladd, Jr. et al.

[11] Patent Number: 4,911,851

[45] Date of Patent: Mar. 27, 1990

[54] DETERGENT COMPATIBLE, DRYER RELEASED FABRIC SOFTENING/ANTISTATIC AGENTS

[75] Inventors: Joseph M. Ladd, Jr., Cleves; Michelle F. Mellea, West Chester; Thomas J. Wierenga, Cincinnati, all of Ohio

[73] Assignee: The Procter & Gamble Company, Cincinnati, Ohio

[21] Appl. No.: 316,550

[22] Filed: Feb. 27, 1989

Related U.S. Application Data

[63] Continuation of Ser. No. 118,578, Jun. 17, 1987.

[51] Int. Cl.[4] ..... C11D 11/00

[52] U.S. Cl. ..... 252/8.8; 252/132; 252/90; 252/155; 252/174.13

[58] Field of Search ..... 252/8.8, 132, 174.13, 252/90, 155

[56] References Cited

U.S. PATENT DOCUMENTS

| | | | |
|---|---|---|---|
| 3,896,033 | 7/1975 | Grimm | 252/8.8 |
| 4,108,600 | 8/1978 | Wong | 8/137 |
| 4,152,272 | 3/1979 | Young | 252/8.8 |
| 4,238,531 | 12/1980 | Rudy et al. | 427/242 |
| 4,421,792 | 12/1983 | Rudy et al. | 427/242 |
| 4,642,258 | 2/1987 | Majewski | 428/68 |
| 4,664,817 | 5/1987 | Wixon | 252/8.8 |
| 4,726,908 | 2/1988 | Kruse | 252/91 |

OTHER PUBLICATIONS

Rosen *Surfactants and Interfacial Phenomena* 282 (1975).

*Primary Examiner*—John F. Niebling
*Assistant Examiner*—Isabelle Rodríguez
*Attorney, Agent, or Firm*—Robert B. Aylor; Richard C. Witte

[57] ABSTRACT

Fabric softener particles comprising an inner core of fabric softening composition and an outer coating completely surrounding said core. The outer coating is substantially water-insoluble and protects the inner core from dissolving when present in a typical fabric laundering operation, but releases the softener composition to the fabrics when the fabrics are dried in a heated dryer. The particles contain water-insoluble particulate materials, e.g., silica particles, having a diameter of greater than about one micron to reduce the shiny appearance of visible softener spots which occasionally are present on fabrics treated with said fabric softener particles and to maintain a relatively constant viscosity.

16 Claims, No Drawings

DETERGENT COMPATIBLE, DRYER RELEASED FABRIC SOFTENING/ANTISTATIC AGENTS

This is a continuation of application Ser. No. 07/118,578, filed on Nov. 6, 1987, now abandoned.

FIELD OF THE INVENTION

The invention pertains to coated particles of fabric softener which are included with detergent in the washing of fabrics. The particles survive the wash and release softener to the fabrics in a heated laundry (fabric) dryer. The invention improves the aesthetic character of any fabric softener deposits on fabrics.

BACKGROUND OF THE INVENTION

The advantages obtained from the application of fabric conditioning agents (i.e., fabric softeners and/or antistatic agents) to laundered fabrics is well known. The present invention pertains to coated particulate softener/antistatic compositions which survive the wash process and release the active softening/-antistatic agent to the laundered fabrics in the dryer.

Fabric softening and antistatic benefits are a desirable part of the laundry process. Softening and antistatic compounds are, in general, quaternary ammonium compounds that are not compatible with anionic surfactants. These compounds will be referred to hereinafter as fabric softening compounds or fabric softeners, although it is to be understood that they deliver both softening and antistatic benefits to fabrics. The opposite electrical charge of the anionic surfactant used in most detergents and the quaternary ammonium fabric softening compounds leads to a mutual attraction which causes precipitation. This, in effect, removes surfactant and fabric softener from solution and reduces the cleaning capacity of the detergent while preventing effective fabric softener deposition on the fabric.

One solution to this incompatibility problem is the separate addition of the fabric softener during either the rinse cycle of the wash or while the fabrics are in the dryer. This increases the inconvenience of using fabric softeners because of the need to add them at a point in the laundering process which is different from that at which the detergent is added.

Various other solutions for this problem of incompatibility between detergent and softening compounds have been proposed in the art. U.S. Pat. No. 3,936,537, Baskerville Jr., issued Feb. 3, 1976, and U.S. Pat. No. 4,095,946, Jones, issued Jun. 20, 1978, teach the use of intimate mixtures of organic dispersion inhibitors (e.g., stearyl alcohol and fatty sorbitan esters) with solid fabric softener to improve the survival of the softener in the presence of detergent in the washer so the softener can act on the fabrics when it melts in the dryer. U.S. Pat. No. 4,234,627, Schilling, issued Nov. 18, 1980, teaches microencapsulation of fabric softener. The microcapsules survive the wash and adhere to the fabric surface. They are then ruptured by subsequent tumbling of the fabric in the dryer, thereby releasing softener to the fabrics. In spite of these developments, there is a clear continuing need for improved methods and compositions which are suitable for conveniently and effectively delivering fabric softeners to fabrics during the home laundering process.

SUMMARY OF THE INVENTION

The present invention is directed to coated, detergent-compatible, dryer-activated fabric softening particles having diameters of from about 5 microns to about 1,500 microns comprising an inner core of a fabric softener composition comprising at least about 10% of a fabric softener, preferably at least about 10% of a cationic fabric softener compound, and a water-insoluble particulate adjuvant having a particle size of greater than about one micron at a level of at least about 4%. The adjuvant makes occasional ordinarily-shiny fabric softener deposits less shiny and, therefore, less noticeable and which by keeping the viscosity of the softener composition relatively constant across the temperature range of a laundry dryer provides more even release of said fabric softener.

The particles can be incorporated into laundry detergents.

DETAILED DESCRIPTION OF THE INVENTION

The present invention relates to coated fabric softener particles which can be added to the wash step of the fabric laundering process and which release softener to fabrics in a laundry dryer. The invention also relates to laundry detergent compositions containing said particles.

A. The Particles

The particles of the present invention comprise an inner core of a fabric softener composition which comprises a cationic fabric softener, and an outer coating which protects the inner core, preferably one which completely surrounds the core and comprises a substantially water-insoluble material having a melting point above about 35° C., preferably above about 50° C. By "substantially water-insoluble" herein is meant having a solubility in 35° C. water of less than about 50 ppm. The particles have diameters of from about 5 microns to about 1,500 microns, preferably greater than about 300 microns, and most preferably greater than about 500 microns, with a number average of from about 600 to about 900 microns. The particles typically will be of a generally spherical shape, but can also have an irregular shape. The particle sizes quoted herein refer to the largest dimension (diameter or length) of the particle.

Typical cationic fabric softeners useful herein are quaternary ammonium salts of the formula $$[R_1R_2R_3R_4N]^+Y^-$$

wherein one or two of $R_1$, $R_2$, $R_3$ and $R_4$ groups is an organic radical containing a group selected from a $C_{12}$–$C_{22}$ aliphatic radical or an alkylphenyl or alkylbenzyl radical having from 10 to 16 carbon atoms in the alkyl chain, the remaining groups being selected from $C_1$–$C_4$ alkyl, $C_2$–$C_4$ hydroxyalkyl and cyclic structures in which the nitrogen atom in the above formula forms part of the ring, and Y constitutes an anionic radical such as halide, nitrate, bisulfate, methylsulfate, ethylsulfate and phosphate, to balance the cationic charge.

In the context of the above definition, the hydrophobic moiety (i.e., the $C_{12}$–$C_{22}$ aliphatic, $C_{10}$–$C_{16}$ alkyl phenol or alkylbenzyl radical) in the organic radical $R_1$ or $R_2$ can be directly attached to the quaternary nitrogen atom or can be indirectly attached thereto through an amide, ester, alkoxy, ether, or like grouping.

The quaternary ammonium compounds useful herein include both water-soluble compounds and substantially water-insoluble compounds which are dispersible in water. For example, imidazolinium compounds of the structure.

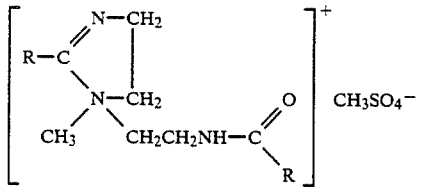

wherein R is a $C_{16}$ to $C_{22}$ alkyl group, possess appreciable water solubility, but can be utilized in the present invention.

The quaternary ammonium softener compounds used in this invention can be prepared in various ways well-known in the art and many such materials are commercially available. The quaternaries are often made from alkyl halide mixtures corresponding to the mixed alkyl chain lengths in fatty acids. For example, the ditallowalkyl quaternaries are made from alkyl halides having mixed $C_{14}$–$C_{18}$ chain lengths. Such mixed di-long chain quaternaries are useful herein and are preferred from a cost standpoint.

The anionic group which can be the counter-ion in the quaternary compounds useful herein is typically a halide (e.g., chloride or bromide), nitrate, bisulfate, ethylsulfate, or methylsulfate. The methylsulfate and chloride ions are the preferred counter-ions from an availability standpoint; while the methylsulfate anion is most preferred because of its minimization of corrosive effects on the automatic clothes dryers in which it is used.

The following are representative examples of quaternary ammonium softening compounds suitable for use in the present invention. All the quaternary ammonium compounds listed can be included in the present invention, but the compilation of suitable quaternary compounds hereinafter is only by way for example and is not intended to be limiting of such compounds. Dioctadecyldimethylammonium methylsulfate is an especially preferred fabric softening compound for use herein, by virtue of its high anti-static, as well as fabric softening activity; ditallowalkyldimethylammonium methylsulfate is equally preferred because of its ready availability and its good antistatic activity; other useful di-long chain quaternary compounds are dicetyldimethylammonium chloride, didocosyldimethylammonium chloride, didodecyldimethylammonium chloride, ditallowalkyldimethylammonium bromide, dioleoyldimethylammonium methylsulfate, ditallowalkyldiethylammonium chloride, ditallowalkyldipropylammonium bromide, ditallowalkyldibutylammonium fluoride, cetyldecylmethylethylammonium chloride, bis-[ditallowalkyldimethylammonium] bisulfate, tris-[ditallowalkyldimethylammonium] phosphate, 1-methyl-1-tallowamidoethyl-2-tallowimidazolinium methylsulfate, and the like. Particularly preferred quaternary ammonium fabric softening compounds are ditallowalkyldimethylammonium chloride and ditallowalkyldimethylammonium methylsulfate. The fabric softener core of the particles of the invention comprises from about 70% to about 98% and most preferably about 85% to about 97% of the particle. All percentages herein are "by weight" unless otherwise indicated.

The core composition can consist entirely of cationic fabric softeners and the "masking adjuvant" described in detail hereinafter. The core will generally comprise at least 10%, usually from about 10% to about 90%, preferably from about 20% to about 60%, cationic fabric softener. Optionally, and preferably, the core can contain additional materials such as perfume, auxiliary fabric softening agents (e.g., smectite clay, fatty alcohols and fatty amine(s), such as ditallowmethyl amine or 1-tallowamidoethyl-2-tallowimidazoline), soil release agents, fabric brighteners, etc. Additional disclosure of materials which can be applied to fabrics along with cationic fabric softening agents in a laundry dryer and, therefore, can be part of the core composition of the particles herein, are disclosed in U.S. Pat. Nos. 4,073,996, Bedenk et al., issued Feb. 14, 1978; 4,237,155, Kardouche, issued Dec. 2, 1980; and 4,421,792, Rudy et al., issued Dec. 20, 1983, all incorporated herein by reference. Preferred additional materials are the encapsulated fabric conditioning perfume microcapsules of U.S. Pat. No. 4,234,627, Schilling, issued Nov. 18, 1980, and British Pat. No. 1,549,432, both of which are incorporated herein by reference. A particularly preferred process for preparing such capsules is disclosed in U.S. Pat. No. 3,697,437, Fogle et al., issued Oct. 10, 1972, incorporated herein by reference. Particles sizes of from about 100 to about 200 microns are preferred.

THE "MASKING" ADJUVANT

The "masking" adjuvants, or agents are water-insoluble, particulate materials that have a particle size of from about one micron to about 15 microns, preferably with a mean of about 2.5 microns. The particles are preferably irregular in shape to promote light diffraction. Smaller particles can be present, but are relatively ineffective and larger particle sizes are undesirable from an efficiency standpoint. A relatively tight distribution of particle sizes is preferred. The particle size range is typically from about one micron to about 15 microns, preferably from about 2 to 10 microns, more preferably from about 2.5 to about 6 microns average diameter on a weight basis. In addition to the particles that are inside the above ranges, small amounts of particles outside said ranges can also be present. Particles within the said ranges are believed to be the operable particles.

The preferred particles are silica particles and include the silica gels such as aerogels and xerogels and agglomerated fumed silicates. Aerogels are preferred. Suitable materials include Syloid® 234, Syloid®235, Syloid®244, and Syloid® 245 Syloid® is a trademark of W. R. Grace & Company, Davison Chemical Division, P.O. Box 3117, Baltimore, Md. 21203.

The primary function of this adjuvant is twofold. The primary function is to reduce the number and/or size of visible deposits of fabric softener on fabrics. In addition, the adjuvant reduces the shiny appearance of melted softener deposits on fabric surfaces. During wash and rinse cycles of a laundry process utilizing a detergent composition comprising the coated fabric softener particles herein, a substantial number of the particles either adhere to the fabric(s), or become entrapped in the fabric(s). When a load of the fabrics is subsequently dried in an automatic clothes dryer at temperatures that typically can range from about 40 to about 120 degrees Centigrade (40°–120° C.), but which more commonly do not exceed about 85° C. The fabric softener melts or is mobilized by the action of heat and moisture, and is distributed throughout the fabric load. In a "pouch" or "sheet" execution of the type described hereinafter, the pouch retains the particles throughout the laundry process. When the pouch and the laundry (fabrics) are subsequently placed in the laundry dryer, the softener in the particles melts and/or is mobilized by the action of the heat and moisture so that said softener is transformed to the fabrics by contact between the pouch and the fabrics during the drying cycle.

In order to provide masking, the masking particles must be distributed (dispersed) throughout the softener and must remain dispersed. The amount of masking particles required is from about 4% to about 20%, preferably from about 6% to about 15%, more preferably from about 8% to about 12% by weight of the softener particle.

THE COATING MATERIALS

The preferred coating materials are substantially water-insoluble materials, typically (but not necessarily) selected from waxy materials such as paraffinic waxes, microcrystalline waxes, animal waxes, vegetable waxes, saturated fatty acids and fatty alcohols having from 12 to 40 carbon atoms in their alkyl chain, and fatty esters such as fatty acid triglycerides, fatty acid esters of sorbitan and fatty acid esters of fatty alcohols, or from substantially water-insoluble polymers. Typical specific suitable waxy coating materials include lauric, myristic, palmitic, stearic, arachidic and behenic acids, stearyl and behenyl alcohol, microcrystalline wax, beeswax, spermaceti wax, candelilla wax, sorbitan tristearate, sorbitan tetralaurate, tripalmitin, trimyristin and octacosane. A preferred waxy material is stearyl alcohol.

Examples of water-insoluble polymeric materials which can be used for the coating of the particles herein are cellulose ethers such as ethyl, propyl or butyl cellulose; cellulose esters such as cellulose acetate, propionate, butyrate or acetate-butyrate; ureaformaldehyde resins, polyvinyl chloride, polyvinylidene chloride, polyethylene, polypropylene, polyacrylates, polymethacrylates, polymethyl-methacrylates and nylon. Such materials and their equivalents are described in greater detail in any conventional handbook of synthetic organic plastics, for example, in Modern Plastics Encyclopaedia Volume, Vol. 62, No. 10A (for 1985–1986) at pages 768–787, published by McGraw-Hill, New York, N.Y. (Oct. 1985), incorporated herein by reference. A preferred polymeric material is ethyl cellulose. The polymeric coating materials can be plasticized with known plasticizing agents such as phthalate, adipate and sebacate esters, polyols (e.g., ethylene glycol), tricresyl phosphate, castor oil and camphor. A preferred polymeric material is ethyl cellulose.

The coating surrounds the cationic fabric softener core and is present in an amount of from about 2% to about 30%, preferably from about 3% to about 15% by weight of the particle.

The coating material can comprise a mixture of waxy coating materials and polymeric coating materials. In such mixtures the waxy coating material will typically comprise from about 70% to about 90% of the mixture and the polymeric material about 30% to about 10%.

Typically, the coating material will have a hardness which corresponds to a needle penetration value of about 0.6 mm or less, and preferably less than about 0.1 mm, as measured by ASTM Test D-1321, modified by using a 100 g weight instead of a 50 g weight. The test is performed at 25°–27° C. In the case of polymeric coating materials, sample preparation is accomplished by dissolving the polymer in a volatile solvent and then evaporating the solvent after the polymer solution has been placed in the test container. For waxy coating materials, sample preparation is done by melting the sample and then solidifying it in the test container in the manner set forth in the ASTM method.

Penetration values of a number of suitable coating materials are shown in the following table.

TABLE 1

Penetration Values of Representative Coating Materials

| Material | Penetration in mm |
|---|---|
| Stearyl alcohol | 0.57 |
| Ethyl cellulose | 0.09 |
| Cellulose acetate | 0.00 |
| Ethyl cellulose + 10% dibutyl sebacate | 0.00 |
| 70% Stearyl alcolhol + 30% $C_{30}$ alcohol | 0.32 |
| 90% Stearyl alcohol + 10% Elvax-4310[1] | 0.12 |
| 90% Stearyl alcohol + 10% BE-Square-195[2] | 0.40 |

[1]Terpolymer of ethylene, vinyl acetate and acid from DuPont
[2]Microcrystalline wax from Petrolite, Specialty Polymers Group The function of the coating which surrounds the fabric softener is to prevent the softener from becoming dissolved and/or dispersed in the wash water when the particles are present during the wash step of a laundry process, and thereby prevent interaction between the fabric softener and the detergent. During the washing and rinsing of the fabrics, a substantial amount of the particles adhere to, or become entrapped within folds of the fabrics. When the fabrics are dried in a heated automatic clothes dryer (typically at temperatures of about 65° to 85° C.), the coating and the fabric softener core composition melt, thereby permitting the softener to spread throughout the fabric load and soften the fabrics. The coating materials are disclosed in the copending U.S. patent application of Wierenga et al. for DETERGENT COMPATIBLE, DRYER RELEASED FABRIC SOFTENING/ANTISTATIC AGENTS, Ser. No. 058,449, filed Jun. 5, 1987.

If the softener particles will survive the conditions of use and be available in the clothes dryer, a coating is not required.

If the particles are incorporated into a granular detergent composition, it is preferred that the particle size of the softener particles be similar to the particle size of the detergent granule in order to minimize segregation. This will typically be in the range of from about 500 to about 1,500 microns. Softener particles which are smaller in size than the detergent granules can be agglomerated to form larger particles to match the particle size of the detergent granules into which they will be incorporated. The agglomeration can be accomplished by using water-soluble or dispersible materials such as polyvinyl alcohol, sodium carboxymethyl cellulose, gelatin and polyoxethylene waxes. The agglomerates disintegrate when the detergent composition is added to water. Methods and agglomerating agents for agglomeration of fabric softener particles are described in U.S. Pat. No. 4,141,841, McDanald, issued Feb. 27, 1979, incorporated by reference herein.

B. Preparation of Particles

In preparing the softener particles of the invention, the solid fabric softener composition and the "masking" adjuvant (MA), which are to be the core of the particles, are formed into particles having a size of from about 5 to about 1,500 microns. This can be accomplished, for example, by milling the solid softener composition or by melting the composition, mixing the MA into the resulting melt, and spraying the melt through appropriate sized nozzles into an atmosphere having a temperature below the melting point of the softener, thereby forming the softener-composition/MA mixture into solid particles.

The particles of softener-composition/MA can then be coated with coating material which is typically either melted or dissolved in a volatile solvent. The coating can be done at a temperature which is below the melting point of the softener composition, and the coated particles are then cooled (or the solvent is evaporated) to solidify the coating. The coating is typically applied in a fluidized bed type apparatus. A suitable type of apparatus is that described in U.S. Pat. No. 3,196,827, Wurster et al., issued Jul. 27, 1965, incorporated by reference herein. In this apparatus, solid softener core particles are suspended in an air stream which carries them in a smooth cyclic flow past the coating nozzle, which sprays them with fluid coating material. Air atomizes and expels the coating fluid through the coating nozzle. The atomized coating fluid covers the surfaces of the core particles. The coated particles are lifted on the air stream and the fluid coating solidifies on the surface of the particles as the air stream lifts them away from the nozzle. The particles then settle out of the air stream and begin another cycle which takes them past the nozzle again. The process is repeated until the desired amount of coating has been deposited on the particles. The amount of coating applied to the softener core particles is typically from about 2% to about 30%, preferably about 15% by weight of total particle (i.e., core plus coating).

Alternatively, other types of encapsulating processes such as described in an article by Nack entitled "Microencapsulation Techniques, Applications and Problems," J. Soc. Cos. Chem., Vol. 21, Pages 85–98 (Feb. 4, 1970), incorporated herein by reference, can be used. When perfume microcapsules are incorporated, the processes disclosed in U.S. Pat. No. 4,234,627, supra, incorporated herein by reference, can be used.

If it is desired to agglomerate the softener/MA particles, this can be accomplished in the following manner. The softener particles are fed to a highly efficient mixer (e.g., Schugi Flexomix Model 160,335 or 400 from Schugi Process Engineers USA, 41-T Tamarack Circle, Skillman, N.J. 08558), or a pan agglomerator. Aqueous solution or dispersion of agglomerating agent is sprayed onto the moving particles causing them to stick to each other. The water is evaporated and the dried agglomerated particles are sized by sieving. Suitable agglomerating agents include dextrin starches, Pluronic Polyols (copolymers of ethylene oxide and/or propylene oxide with either ethylene glycol or propylene glycol) and hydratable salts such as sodium tripolyphosphate or sodium sulfate.

The type of apparatus described in U.S. Pat. No. 3,196,827 (Wurster et al.), cited supra, can also be used for agglomerating particles.

C. Detergent Compositions

The particles of the present invention are preferably formulated into detergent compositions. Such compositions typically comprise detersive surfactants and detergency builders and, optionally, additional ingredients such as bleaches, enzymes, fabric brighteners and the like. The particles are present in the detergent composition at a level sufficient to provide from about 0.5% to about 10%, and preferably from about 1% to about 5% of quaternary ammonium fabric softener in the detergent composition. The remainder of the detergent composition will comprise from about 1% to about 50%, preferably from about 10% to about 25% detersive surfactant, and from about 10% to about 80%, preferably from about 20% to about 50% of a detergency builder, and, if desired, other optional laundry detergent components.

1. The Surfactant

Surfactants useful in the detergent compositions herein include well-known synthetic anionic, nonionic, amphoteric and zwitterionic surfactants. Typical of these are the alkyl benzene sulfonates, alkyl- and alkylether sulfates, paraffin sulfonates, olefin sulfonates, alkoxylated (especially ethoxylated) alcohols and alkyl phenols, amine oxides, alpha-sulfonates of fatty acids and of fatty acid esters, alkyl betaines, and the like, which are well known from the detergency art. In general, such detersive surfactants contain an alkyl group in the $C_9$–$C_{18}$ range. The anionic detersive surfactants can be used in the form of their sodium, potassium or triethanolammonium salts; the nonionics generally contain from about 5 to about 17 ethylene oxide groups. $C_{11}$–$C_{16}$ alkyl benzene sulfonates, $C_{12}$–$C_{18}$ paraffin-sulfonates and alkyl sulfates are especially preferred in the compositions of the present type.

A detailed listing of suitable surfactants for the detergent compositions herein can be found in U.S. Pat. No. 3,936,537, Baskerville, issued Feb. 3, 1976, incorporated by reference herein. Commercial sources of such surfactants can be found in McCutcheon's EMULSIFIERS AND DETERGENTS, North American Edition, 1984, McCutcheon Division, MC Publishing Company, also incorporated herein be reference.

2. Detergency Builders

Useful detergency builders for the detergent compositions herein include any of the conventional inorganic and organic water-soluble builder salts, as well as various water-insoluble and so-called "seeded" builders.

Nonlimiting examples of suitable water-soluble, inorganic alkaline detergent builder salts include the alkali metal carbonates, borates, phosphates, polyphosphates, tripolyphosphates, bicarbonates, silicates, and sulfates. Specific examples of such salts include the sodium and potassium tetraborates, bicarbonates, carbonates, tripolyphosphates, pyrophosphates, and hexametaphosphates.

Examples of suitable organic alkaline detergency builder salts are: (1) water-soluble amino polyacetates, e.g., sodium and potassium ethylenediaminetetraacetates, nitrilotriacetates, and N-(2-hydroxyethyl)nitrilodiacetates; (2) water-soluble salts of phytic acid, e.g., sodium and potassium phytates; (3) water-soluble polyphosphonates, including sodium, potassium and lithium salts of ethane-1-hydroxy-1,1-diphosphonic acid, sodium, potassium, and lithium salts of methylenediphosphonic acid and the like.

Seeded builders include such materials as sodium carbonate or sodium silicate, seeded with calcium carbonate or barium sulfate. Hydrated sodium Zeolite A having a particle size of less than about 5 microns is particularly desirable.

A detailed listing of suitable detergency builders can be found in U.S. Pat. No. 3,936,537, supra, incorporated herein by reference.

3. Optional Detergent Ingredients

Optional detergent composition components include enzymes (e.g., proteases and amylases), halogen bleaches (e.g., sodium and potassium dichloroisocyanurates), peroxyacid bleaches (e.g., diperoxydodecane-1,12-dioic acid), inorganic percompound bleaches (e.g., sodium perborate), activators for perborate (e.g., tetraacetylethylenediamine and sodium nonanoyloxybenzene sulfonate), soil release agents (e.g., methylcellulose) soil suspending agents (e.g., sodium carboxymethylcellulose) and fabric brighteners.

D. Pouched Compositions

When fabric softener particles of the invention are added to the wash step of a laundering process, it is inevitable that some of the particles will not adhere to or become trapped in the folds of the fabrics and will, therefore, be lost in the discarded wash solution or rinse water. In order to avoid such loss, the particles can be added to the wash solution in a sealed, porous water-insoluble pouch such as the type described in U.S. Pat. No. 4,223,029, Mahler et al., issued Sept. 16, 1980, incorporated by reference herein. Detergent granules can be included in the pouch with the softener particles. When the pouch is placed in water in the wash step of the laundering process, the detergent dissolves, but the softener particles remain in the pouch. The pouch remains with the fabrics through the wash and rinse. When the pouch is tumbled with the fabrics in the dryer, the softener particles release the softener, which melts onto the pouch material and is transferred from the pouch material to the fabrics as the pouch comes into contact with the fabrics during the drying cycle. Preferred pouch structures are multi-pouch porous sheet structures such as described in application U.S. Ser. No. 675,804, Bedenk et al., filed Nov. 28, 1984, now U.S. Pat. Nos. 4,638,907, Bedenk/Harden, issued Jan. 27, 1987; and U.S. Pat. No. 4,259,383, Eggensperger et al., issued Mar. 31, 1981, both incorporated herein by reference. In a single pouch structure, the particles tend to collect in a relatively small area of the structure, whereas in a multi-pouch sheet structure the softener particles are distributed over a larger area of the structure thereby facilitating more even transfer of softener to fabrics in the dryer.

Suitable pouch materials include, paper, nonwoven synthetics such as spunbonded and wet laid polyester, and porous formed film plastic sheet material.

All percentages, parts, and ratios herein are by weight unless otherwise specified.

EXAMPLE 1

In this Example, various silica materials are tested for their effect on viscosity and "staining" of a softener material. In general, it is desired that the viscosity, across the temperature range in a dryer, should be relatively constant to provide even release. Surprisingly, the least "staining" in the sense of visible deposits of softener material is obtained, with relatively low viscosities, e.g., from about 5,000 to about 20,000 mPas, preferably from about 8,000 to about 15,000 mPas. A relatively high (~8%) level of a larger (~2.5 micron) silica gel particle is better than even higher levels (~10%) of a smaller (<1 micron) particle size/silica gel.

The viscosity data in the table hereinafter is obtained on a ROTOVISCO 12 viscometer using a 500 measuring drive and an SVI measuring system (except Sample 1 which used an NV), a shear rate at 2.5, a Gain of 1.0, Factor A of 12.40 except for Sample 1, where it is 1.78, Factor M of 0.89 except for Sample 1 where it is 5.41, a temperature of about 56° C. ±1° C., a hold time $t^1$ of about 2 minutes, a ramp time $t^2$ of about 0.1 minute, and a hold time $t^3$ of 40 minutes except for Sample 8 (35 minutes) and Samples 2 and 3 (30 minutes).

The stains are read by expert graders who grade both sides of 9 representative swatches of fabric 15 inches by 20 inches in size. The grading system is from 0 to 5 with 0 being no stain,
1 being small stains that a consumer would not notice,
2 being visible stains that a consumer might notice,
3 being easily visible,
4 being a serious stain that would be unacceptable, and
5 being very serious staining with heavy coverage.

"Serious Stains" in the results refers to the number of swatches with a grade of 3 or more.

The samples tested are as follows:

| Component | % by Weight |
|---|---|
| SAMPLE 1 | |
| Tallow Alkyl Dimethyl Amine | 43.35 |
| Stearic Acid | 41.65 |
| Methyl-1-tallow amido ethyl-2-tallow imidazolinium methyl sulfate (Varisoft ® 475, 90% active)* | 15.00 |
| Total | 100.00 |
| SAMPLE 2 | |
| Tallow Alkyl Dimethyl Amine | 38.25 |
| Stearic Acid | 36.75 |
| Methyl-1-tallow amido ethyl-2-tallow imidazolinium methyl sulfate | 15.00 |
| Bentonite Clay | 7.50 |
| Perfume | 2.50 |
| Total | 100.00 |
| SAMPLE 3 | |
| Tallow Alkyl Dimethyl Amine | 36.98 |
| Stearic Acid | 35.52 |
| Methyl-1-tallow amido ethyl-2-tallow imidazolinium methyl sulfate | 15.00 |
| Cab-O-Sil ® (Fumed Silica) | 10.00 |
| Perfume | 2.50 |
| Total | 100.00 |
| SAMPLE 4 | |
| Tallow Alkyl Dimethyl Amine | 37.74 |
| Stearic Acid | 36.26 |
| Methyl-1-tallow amido ethyl-2-tallow imidazolinium methyl sulfate | 15.00 |
| Bentonite Clay | 5.00 |
| Cab-O-Sil ® (Fumed Silica) | 3.00 |
| Perfume | 3.00 |
| Total | 100.00 |
| SAMPLE 5 | |
| Tallow Alkyl Dimethyl Amine | 40.29 |
| Stearic Acid | 38.71 |
| Methyl-1-tallow amido ethyl-2-tallow imidazolinium methyl sulfate | 15.00 |
| Syloid ® 234 | 6.00 |
| Total | 100.00 |
| SAMPLE 6 | |
| Tallow Alkyl Dimethyl Amine | 39.27 |
| Stearic Acid | 37.73 |
| Methyl-1-tallow amido ethyl-2-tallow imidazolinium methyl sulfate | 15.00 |
| Syloid ® 234 | 8.00 |
| Total | 100.00 |
| SAMPLE 7 | |
| Tallow Alkyl Dimethyl Amine | 40.29 |
| Stearic Acid | 38.71 |
| Methyl-1-tallow amido | 15.00 |

-continued

| Component | % by Weight |
|---|---|
| ethyl-2-tallow imidazolinium methyl sulfate | |
| Syloid ® 266FP | 6.00 |
| Total | 100.00 |
| SAMPLE 8 | |
| Tallow Alkyl Dimethyl Amine | 36.72 |
| Stearic Acid | 35.28 |
| Methyl-1-tallow amido ethyl-2-tallow imidazolinium methyl sulfate | 20.00 |
| Urea | 8.00 |
| Total | 100.00 |

*Available from Sherex Chemical Co., P.O. Box 646, Dublin, Ohio 43017.

In the above, the particle size of the bentonite clay is less than 75 microns, the Cab-O-Sil ® is fumed silica having an average particle size of less than about 1 micron, the Syloid ® 266FP is a silica gel (average particle size—2 microns), and the Syloid ® 234 is a silica gel (average particle size—2.5 microns).

The above Samples are converted into particles by cooling and grinding (~600–1700 microns) and placed in the six-pouch sheet described hereinafter. The sheet/-softener compositions were placed in the rinse cycle of a conventional washer with a representative load of fabrics and the "stain" swatches. After rinsing, the fabric, swatches, and softener are placed in a conventional dryer and dried for fifty minutes.

The results are as follows:

TABLE 2

| Sample No. | Viscosities (mPas $10^3$) ~55° C. | ~80° C. | Grams of Softener Released | Serious Stains |
|---|---|---|---|---|
| 1 | 1.5 | 2.7 | 1.06 g | 7.0 |
| 2 | 64.8 | 22.5 | .82 g | 6.3 |
| 3 | 130.0 | 45.0 | 1.00 g | 5.7 |
| 4 | 30.0 | 6.0 | 1.04 g | 5.3 |
| 5 | 10.0 | 8.5 | 1.23 g | 4.6 |
| 6 | 12.0 | 10.0 | .84 g | 2.3 |
| 7 | 9.5 | 8.0 | 1.09 g | 4.0 |
| 8 | 11.4 | 9.4 | .69 g | 5.6 |

The number and severity of "stains" are less when the MA is present.

Softener compositions are prepared according to the following formulae:

| Ingredient | % by Weight Formula A | Formula B |
|---|---|---|
| Alkyl Dimethyl Amine | 36.72 | 33.53 |
| Stearic Acid | 35.28 | 32.22 |
| Methyl-1-tallow amido ethyl-2-tallow imidazolinium methyl sulfate (Varisoft ® 475, 90% active) | 20.00 | 20.00 |
| Syloid ® 234 | 8.00 | 8.00 |
| Perfume Capsules | — | 6.25 |
| Totals | 100.00 | 100.00 |

The alkyl dimethyl amine and the stearic acid are placed into a PVM 10 Ross mixer (Charles Ross & Sons Company, Hauppauge, N.Y. 11788) and heated to 75°–80° C. Once the temperature has stabilized, the ingredients are mixed for at least ½ hour to allow an ion pair complex to form. This process is detailed in U.S. Pat. No. 4,237,155, incorporated herein by reference.

Once the complex has formed, Varisoft ® 475, 90% active, is blended into the ion pair and stabilized at 75°–80° C. Once temperature stabilization has occurred, the mixture is placed under a vacuum of 254–381 mm Hg. The "masking" adjuvant, e.g., Syloid ® 234, is introduced to the system through an external tube which draws the Syloid under the surface of the softener mix. Perfume capsules, if present, are added last and blended into the softener matrix to form a homogenous suspension of capsules. Afterwards, blending continues for 5–10 minutes, allowing thorough mixing of ingredients while removing residual isopropanol from the system. The softener mix is then poured into containers and stored until particle formation is required.

The particles are formed by any convenient method. Preferably, the softener composition is poured into trays and cooled overnight at about 4° C.

The solid softener core composition is then converted to particles by milling in a Fitzmill, Model DA506 (The Fitzpatrick Company, Elmhurst, Ill. 60126) at 4740 rpm's through a 4 mesh screen. The particles are then sized through 11 on 26 (U.S. Standard screens, (0.6–1.7 mm) particle size).

The particles are then coated with a 10% solution of Ethocel in methanol. The coating is applied in an 18 inch Wurster Coater (Coating Place, Inc., P.O. Box 248, Verona, Wis. 53593). The ethyl cellulose used is Ethocel Std. 10 (Dow Chemical Co., Midland, Mich. 48640), which has an Ubbelohde viscosity of 9.0–11.0, measured at 25° C. as a 5% solution in 80% toluene/20% ethanol.

The following conditions are used to apply the cellulose-based coating:

| | |
|---|---|
| Fluidizing Air | 15.8 Cu.M/min. at 40.5° C. |
| Atomizing Air Volume | 0.37 Cu.M/min. |
| Atomizing Air Rate | 5624 g/sq.cm. |
| Inlet Air Temperature | 38°–43° C. |
| Outlet Air Temperature | 30°–32° C. |
| Pump Rate | 0.2 Kg/min. |
| Nozzle Size | CPI-18-A74* |
| Partition Gap | 216 mm × 267 mm |
| Partition Size | 19 mm |
| Run Time | 55 min. |

*Available from Coating Place, Inc.

The amount of coating applied to the particles is about 3% by weight of the total coated particle weight. When the coating is completed, the softener particles are resized through 11 on 26 mesh U.S. Standard screens and are then ready for use "as is" or for blending into detergent granules.

The resulting coated particles are Composition A and Composition B, respectively.

The above coated softeners are combined with the following Detergent Compositions and Bleach Composition.

Detergent Compositions

| Ingredient | Nil P Formula (parts by weight | Phosphate Formula |
|---|---|---|
| Na $C_{13}$ linear alkyl benzene sulfonate | 14.0 | 8.8 |
| Na $C_{14}$–$C_{15}$ fatty alcohol sulfate | 14.0 | 8.8 |
| $Na_2SO_4$ | 14.6 | 9.2 |
| Sodium citrate (Na citrate) | 9.8 | — |
| Hydrated sodium Zeolite A (~2 microns) (Na7A) | 16.2 | — |
| Sodium tripolyphosphate (STPP) | — | 53.0 |
| Sodium silicate (1.6 r) | — | 5.9 |

-continued

| | | |
|---|---|---|
| $Na_2CO_3$ | — | 5.2 |
| Polyethylene glycol (PEG) | — | 1.1 |
| Mixture of tartrate monosuccinate (TMS) and tartrate disuccinate (TDS) in a ratio of about 85/15 | 10.3 | — |
| Optical brightener | 1.2 | 1.1 |
| Protease enzyme (Alcalase) | — | 1.8 |
| Moisture and miscellaneous | 11.5 | 5.6 |

Bleach Composition

| Ingredient | Weight % |
|---|---|
| Diperoxydecanedioic acid | 23.2 |
| Dodecanedioic acid | 2.3 |
| Na $C_{13}$ linear alkylbenzene sulfonate | 5.1 |
| Boric acid | 25.6 |
| Sodium sulfate | 43.6 |
| Miscellaneous | 0.2 |
| Total | 100.0 |

Composition C

A detergent/softener composition is prepared using 2.2 parts of the coated softeners Composition A and Composition B, respectively, coated with Ethocel as described hereinbefore; and 97.8 parts of the above Phosphate Formula Detergent Composition. A bleach softener composition is prepared using 2.5 parts of the same said coated softener compositions and 97.5 parts of the above Bleach Composition.

The detergent/softener and bleach/softener compositions are placed into a six-pouch product "sheet" comprised of a bottom sheet of Reemay ® 2420 spunbonded polyester with a soil release polymer coating (DuPont) and a cover sheet of James River 5227 polyester/wood pulp blend (James River Corp.) which are laminated together so as to form six equal sized pouches. In between the sheets is a polyethylene template. The sheets are approximately 4.3 inches × 11 inches (approximately 11 cm × 28 cm). Four of the pouches contain a total of 58.3 grams of the detergent/softener composition and the remaining two pouches contain 26.7 grams of the bleach/softener composition.

The finished "sheet" compositions (products) provide superior cleaning and fabric treatment, e.g., softening and antistatic, benefits.

Composition D

A detergent/softener composition is prepared using 2.4 parts of the coated softeners Composition A and Composition B, respectively, coated with Ethocel as described hereinbefore and 97.6 parts of the above Nil P Formula Detergent Composition. A bleach/softener composition is prepared using 3.4 parts of the same coated softener compositions and 96.6 parts of the above Bleach Composition.

54.3 grams of the detergent/softener composition are placed in four pouches and 19.7 grams of the bleach-/softener composition are placed in two pouches of the six-pouch sheet described in Composition C.

EXAMPLE II

Fabric softener core particles are prepared according to the following formula:

| Ingredient | Weight % |
|---|---|
| Ditallowdimethylammonium methylsulfate (DTDMAMS) | 44.0 |
| Cetyl Alcohol | 22.0 |
| Sorbitan Monostearate | 22.0 |

-continued

| Ingredient | Weight % |
|---|---|
| Syloid ® 234 | 12.0 |
| Total | 100.0 |

The DTDMAMS, cetyl alcohol and sorbitan monostearate are blended together in a PVM 40 Ross mixer (Charles Ross & Sons Company, Hauppauge, N.Y. 11788) at about 71° C. The molten "triblend" is then mixed for one hour. At the end of one hour, the temperature is raised to 79°-85° C. under vacuum (about 330-430 mm Hg). When the temperature has stabilized in this range, the Ross anchor and disperser are turned on and the Syloid ® 234 is added, the mixture is blended for 5 minutes and then sheared with the Ross colloid mixer for 10 minutes. The softener composition is then poured into trays and cooled overnight at about 4° C. Particles are formed as in Example I.

EXAMPLE III

A detergent/softener composition is prepared by mixing 5.2 parts of the coated softener particles of Example I or II with 94.8 parts of the following granular detergent composition:

| Ingredient | Parts |
|---|---|
| Na $C_{13}$ linear alkyl benzene sulfonate | 9.5 |
| Na $C_{14}$-$C_{15}$ fatty alcohol sulfate | 9.5 |
| Ethoxylated $C_{12}$-$C_{13}$ fatty alcohol | 1.9 |
| $Na_2SO_4$ | 11.1 |
| Sodium silicate (1.6 r) | 6.5 |
| Polyethylene glycol (M.W. 8,000) | 0.7 |
| Polyacrylic aicd (M.W. 1,200) | 0.9 |
| Sodium tripolyphosphate | 31.0 |
| Sodium pyrophosphate | 7.5 |
| $Na_2CO_3$ | 10.2 |
| Optical brightener | 0.2 |
| Protease enzyme (Alcalase) | 0.7 |
| Moisture | 9.3 |
| Miscelleneous | 1.0 |
| Total | 100.0 |

EXAMPLE IV

An alternate granular detergent/softener composition is prepared by mixing 5.2 parts of the coated softeners of Example I or II with 94.8 parts of the following granular detergent composition:

| Ingredient | Parts |
|---|---|
| Na $C_{13}$ linear alkyl benzene sulfonate | 11.5 |
| Na $C_{14}$-$C_{15}$ fatty alcohol sulfate | 11.5 |
| Ethoxylated $C_{12}$-$C_{13}$ fatty alcohol | 1.9 |
| $Na_2SO_4$ | 14.0 |
| Sodium silicate (1.6 r) | 2.3 |
| Polyethylene glycol (M.W. 8,000) | 1.8 |
| Polyacrylic acid (M.W. 1,200) | 3.5 |
| Hydrated Zeolite A (~2 microns) | 28.9 |
| $Na_2CO_3$ | 17.0 |
| Optical brightener | 0.2 |
| Protease enzyme (Alcalase) | 0.6 |
| Moisture and Miscellaneous | 7.0 |
| Total | 100.2 |

EXAMPLE V

A laundering article in the form of a pouched sheet is prepared as follows.

The pouched product is comprised of two sheets of James River 9214-02, a 1.3 oz./sq. yard carded, a thermo bonded polypropylene/polyester nonwoven substrate that is laminated together to form two pouches 4.0 inches by 3.0 inches (10.0 cm×7.5 cm) each with a total outer dimension of approximately 7.0 inches×4.5 inches (17.5 cm×11.0 cm). Each pouch contains about 25 gms of either the detergent/softener composition of Example III or Example IV.

The article is suitable for washing and softening laundry in a process involving washing and rinsing the fabrics, followed by tumble drying in a heated clothes dryer, wherein the article remains with the laundry throughout the entire process.

What is claimed is:

1. A detergent-compatible, fabric softener composition in particulate form, the said particles comprising a fabric softener composition comprising:
   (i) at least about 10% of a fabric softener, the said softener composition having a melting point of from about 50° C. to about 80° C. and
   (ii) at least 4% of a water-insoluble silica particulate adjuvant having a particle size of more than about one micron to lessen the number of undesirable visible fabric softener deposits on fabrics; and the said particles having a size of from about 300 to about 1,500 microns, said particles being activated in a heated laundry dryer.

2. A detergent-compatible, fabric softener composition in particulate form, the said particles comprising:
   (a) an inner core of fabric softener composition comprising:
      (i) at least about 10% of a fabric softener, the said softener composition having a melting point of from about 50° C. to about 80° C. and
      (ii) at least 5% of a water-insoluble silica particulate adjuvant having a particle size of more than about one micron to lessen the number of undesirable visible fabric softener deposits on fabrics; and
   (b) a coating surrounding said core to protect said softener from detergents;

the said coating comprising from about 2% to about 30% of said particle and the said inner core comprising from about 98% to about 70% of said particle, the said particles having a size of from about 300 to about 1,500 microns, said particles being activated in a heated laundry dryer.

3. The particulate composition of claim 2 wherein the cationic softener in the inner core (a) is of the formula $$[R_1R_2R_3R_4N]^+Y^-$$

wherein one or two of the $R_1$, $R_2$, $R_3$ and $R_4$ groups is an organic radical containing a group selected from $C_{12}$–$C_{22}$ aliphatic radicals having from 10 to 16 carbon atoms in the alkyl chain and alkylbenzyl radicals having from 10 to 16 carbon atoms in the alkyl chain, the remaining groups being selected from $C_1$–$C_4$ alkyl, $C_2$–$C_4$ hydroxyalkyl, and cyclic structures in which the nitrogen atom in the formula forms part of a ring, and wherein $Y^-$ is an anionic radical, and wherein the cationic softener comprises from about 10% to about 50% of the softener composition of the inner core (a), and wherein the coating (b) comprises from about 3% to about 15% of said particle.

4. The particulate composition of claim 2 wherein the coating (b) has a melting point above about 35° C. and a penetration value of no more than about 0.6 mm as measured by ASTM Test D-1321, modified by using a 100 gram weight.

5. The particulate composition of claim 4 wherein the coating (b) comprises a material selected from substantially water-insoluble polymers, paraffinic waxes, microcrystalline waxes, animal waxes, vegetable waxes, saturated fatty acids, saturated fatty alcohols and saturated fatty esters.

6. The composition of claim 2 wherein said inner core (a) additionally comprises microcapsules of fabric conditioning compositions that comprise materials that are not cationic fabric softeners.

7. The composition of claim 6 wherein said fabric conditioning compositions comprise at least one perfume material.

8. The composition of claim 7 wherein said perfume is encapsulated in a cross-linked gelatin.

9. The particulate composition of claim 2 wherein the adjuvant, (a)(ii), is a silica particle having a particle size range of from about 1 to about 15 microns and said adjuvant is present at a level of from about 5% to about 20%.

10. The particulate composition of claim 9 wherein the adjuvant, (a)(ii), is a silica gel having a particle size of from about 2 to about 10 microns, and said adjuvant is present at a level of from about 6% to about 15%.

11. The particulate composition of claim 10 wherein the particle size of said adjuvant (a)(ii), is from about 2.5 to about 6 microns average diameter on a weight basis, and said adjuvant is present at a level of from about 8% to about 12%.

12. The particulate composition of claim 10 wherein said adjuvant, (a)(ii), is an aerogel.

13. The particulate composition of claim 10 wherein the cationic softener in the inner core (a) is of the formula $$[R_1R_2R_3R_4N]^+Y^-$$

wherein one or two of the $R_1$, $R_2$, $R_3$ and $R_4$ groups is an organic radical containing a group selected from $C_{12}$–$C_{22}$ aliphatic radicals having from 10 to 16 carbon atoms in the alkyl chain and alkylbenzyl radicals having from 10 to 16 carbon atoms in the alkyl chain, the remaining groups being selected from $C_1$–$C_4$ alkyl, $C_2$–$C_4$ hydroxyalkyl, and cyclic structures in which the nitrogen atom in the formula forms part of a ring, and wherein $Y^-$ is an anionic radical, and wherein the cationic softener comprises from about 10% to about 50% of the softener composition of the inner core (a), and wherein the coating (b) comprises from about 3% to about 15% of said particle.

14. The particulate composition of claim 13 wherein the coating (b) has a melting point above about 35° C. and a penetration value of no more than about 0.6 mm as measured by ASTM Test D-1321, modified by using a 100 gram weight.

15. The particulate composition of claim 14 wherein the coating (b) comprises a material selected from substantially water-insoluble polymers, paraffinic waxes, microcrystalline waxes, animal waxes, vegetable waxes, saturated fatty acids, saturated fatty alcohols and saturated fatty esters.

16. A pouched sheet formed from a porous substrate and containing a particulate detergent composition and a sufficient amount of the particulate composition of claim 1 to provide from about 0.5% to about 10% of said fabric softener.

* * * * *